US007626550B2

(12) United States Patent
Tsai et al.

(10) Patent No.: US 7,626,550 B2
(45) Date of Patent: Dec. 1, 2009

(54) ELECTRONIC DEVICE AND ANTENNA THEREOF

(75) Inventors: Feng-Chi Eddie Tsai, Taipei (TW); Kuan-Hsueh Tseng, Taipei (TW); Jiunn-Ming Huang, Taipei (TW)

(73) Assignee: Wistron NeWeb Corp., Taipei Hsien (TW)

( * ) Notice: Subject to any disclaimer, the term of this patent is extended or adjusted under 35 U.S.C. 154(b) by 405 days.

(21) Appl. No.: 11/752,884

(22) Filed: May 23, 2007

(65) Prior Publication Data

US 2008/0030405 A1 Feb. 7, 2008

(30) Foreign Application Priority Data

Jun. 12, 2006 (TW) ..... 95210218 U

(51) Int. Cl.
*H01Q 1/38* (2006.01)

(52) U.S. Cl. ..... 343/700 MS

(58) Field of Classification Search ..... 343/700 MS, 343/702, 725, 846

See application file for complete search history.

(56) References Cited

U.S. PATENT DOCUMENTS

| | | | | |
|---|---|---|---|---|
| 6,903,690 | B2 * | 6/2005 | Leclerc et al. | 343/700 MS |
| 7,053,844 | B2 * | 5/2006 | Gaucher et al. | 343/702 |
| 7,233,290 | B2 * | 6/2007 | Liu et al. | 343/700 MS |
| 7,312,756 | B2 * | 12/2007 | Tsai et al. | 343/702 |
| 7,498,992 | B2 * | 3/2009 | Hung et al. | 343/702 |

* cited by examiner

*Primary Examiner*—Huedung Mancuso
(74) *Attorney, Agent, or Firm*—Quintero Law Office

(57) ABSTRACT

An antenna comprising a ground element, a first conductive element, a first transmission element, a second transmission element and a third transmission element. The first conductive element is connected to the ground element. The first transmission element is connected to the first conductive element extending in a first direction. The second transmission element is connected to the first conductive element. The third transmission element is connected to the first conductive element extending in a second direction opposite to the first direction, wherein the third transmission element nears the second transmission element, and maintains a distance from the second transmission element.

25 Claims, 15 Drawing Sheets

A1

ELECTRONIC DEVICE AND ANTENNA THEREOF

BACKGROUND OF THE INVENTION

1. Field of the Invention

The invention relates to electronic antennae, and in particular to an electronic device and a wideband antenna thereof.

2. Description of the Related Art

FIG. 1*a* shows a conventional antenna, comprising a ground element 10, a conductive element 20 and a transmission element 30. The conductive element 20 is connected to the ground element 10, and the transmission element 30 is connected to the conductive element 20.

With reference to FIG. 1*b*, when conventional antenna 1 transmits a WWAN (Wireless Wide Area Network) signal, antenna 1 provides a bandwidth between 850-1050 MHz and 1600-2100 MHz, wherein bandwidth is defined as signals having VSWR (Voltage Standing Wave Ratio) lower than 4.

Current antenna transmission requirements, however, dictate IEEE 802.11b/g (2.4-2.5 GHz), IEEE 802.11a (4.9-5.85 GHz), and AMPS (824-894 MHz) signals in a single transmission device. Bandwidths of conventional antennae cannot satisfy this requirement.

BRIEF SUMMARY OF THE INVENTION

A detailed description is given in the following embodiments with reference to the accompanying drawings.

An antenna is provided, comprising a ground element, a first conductive element, a first transmission element, a second transmission element, and a third transmission element. The first conductive element is connected to the ground element. The first transmission element is connected to the first conductive element extending in a first direction. The second transmission element is connected to the first conductive element. The third transmission element is connected to the first conductive element extending in a second direction opposite to the first direction, wherein the third transmission element nears the second transmission element, and maintains a first distance from the second transmission element.

In an embodiment, the first conductive element comprises a first portion and a second portion, the first portion connected to the ground element, the second portion connected to the first portion, and the first transmission element, the second transmission element, and the third transmission element connected to the second portion.

In an embodiment, the first conductive element comprises a first portion and a second portion, the first portion connected to the ground element, the second portion connected to the first portion, and the first transmission element, the second transmission element, and the third transmission element are connected to the second portion.

In an embodiment, the antenna further comprises a second conductive element and a sixth transmission element. The second conductive element is connected to the ground element. The sixth transmission element is connected to the second conductive element extending in the second direction.

The antenna of the invention provides an improved transmission and a wider bandwidth between 0.8-0.95 GHz, 1.7-2.2 GHz, 2.4-2.6 GHz, and 4.4-6.0 GHz.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
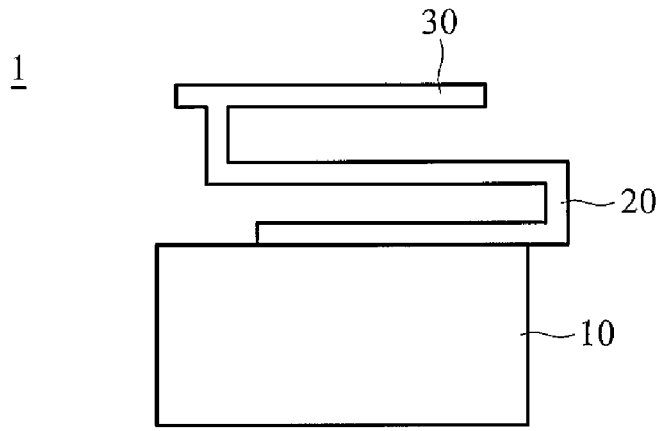
FIG. 1a ( RELATED ART )
FIG. 1*a* shows a conventional antenna.
Figure 1B:
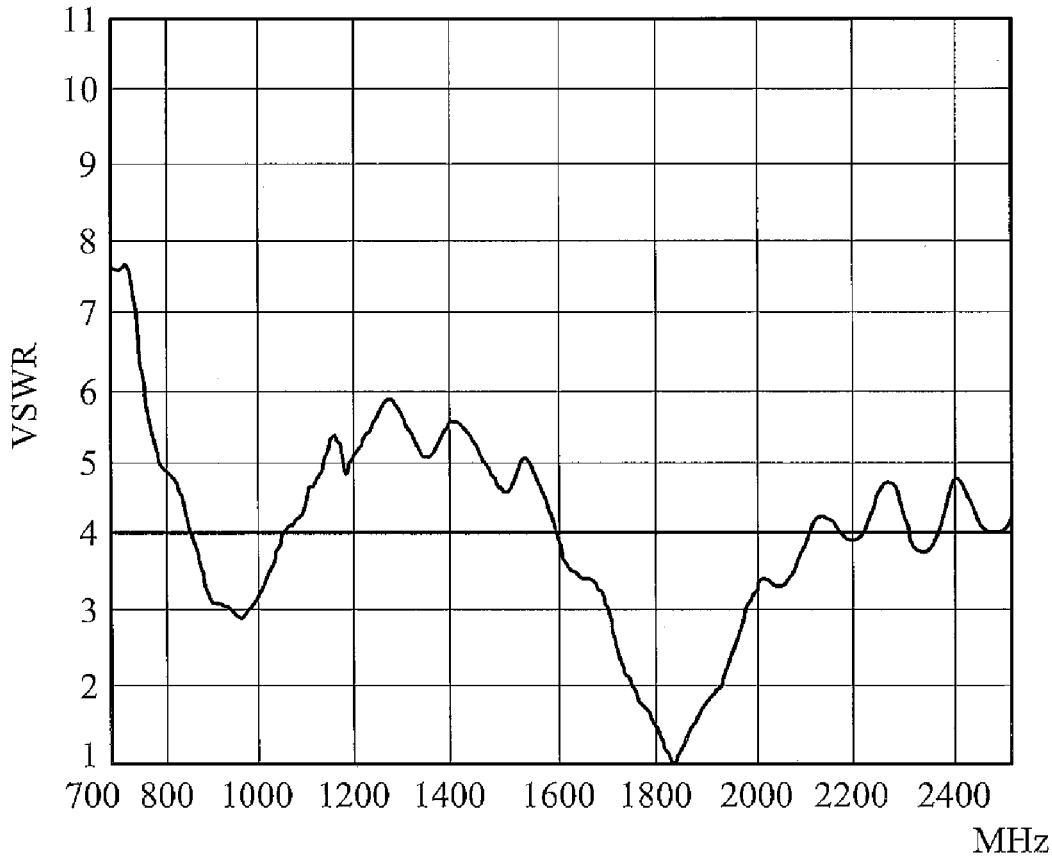
FIG. 1b ( RELATED ART )
FIG. 1*b* shows transmission of the conventional antenna.
Figure 2:
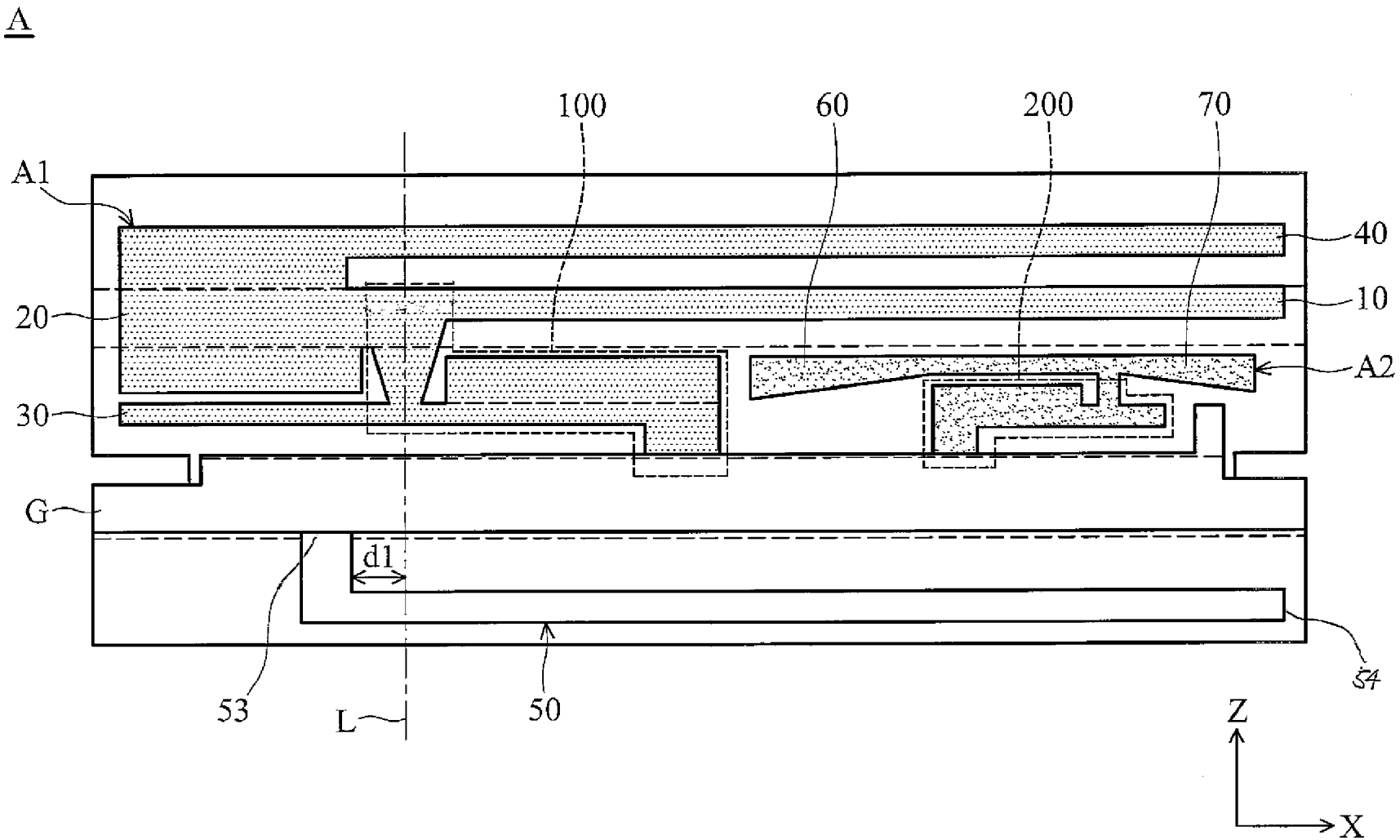
FIG. 2 is an extended view of a first embodiment of the invention.
Figure 3A:
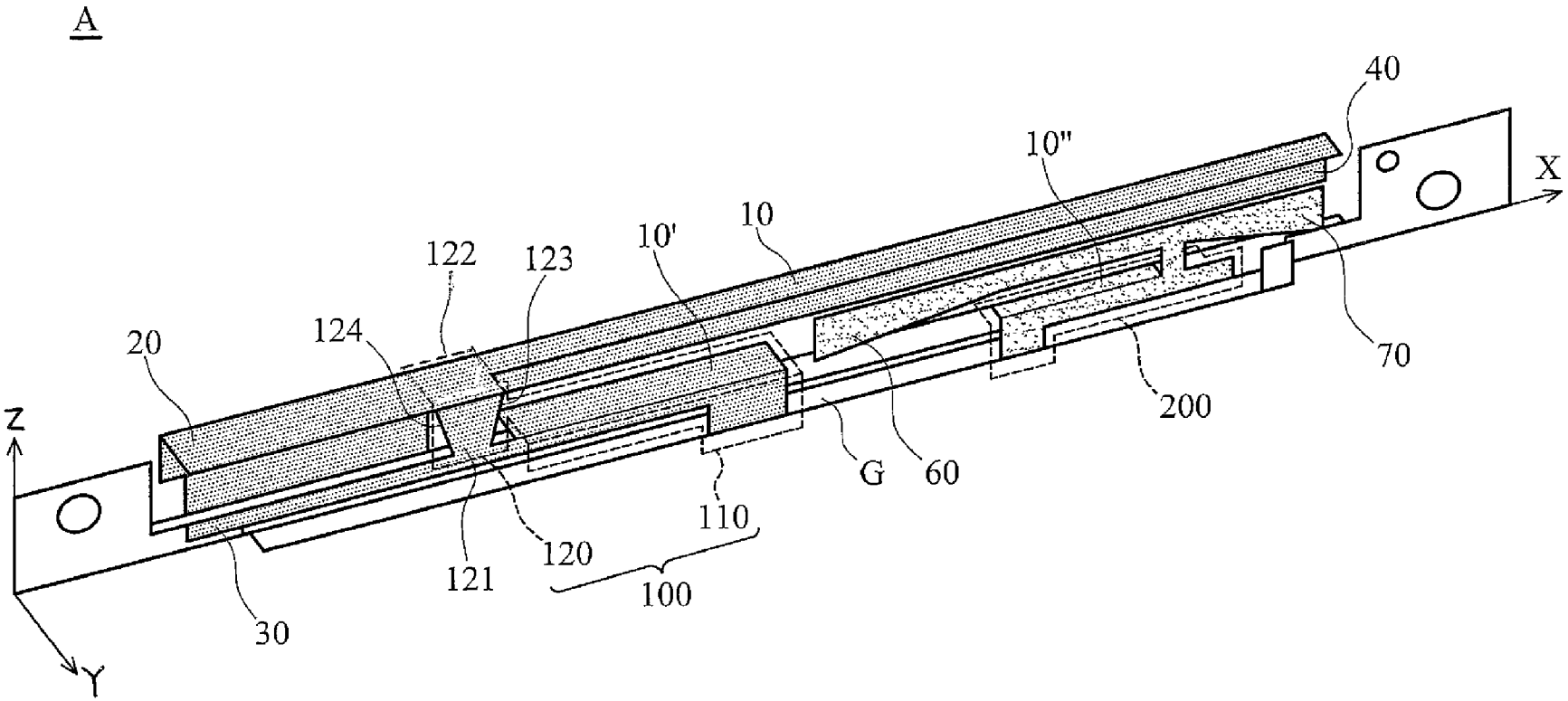
FIGS. 3*a* and 3*b* are perspective views of the first embodiment of the invention.
Figure 3B:
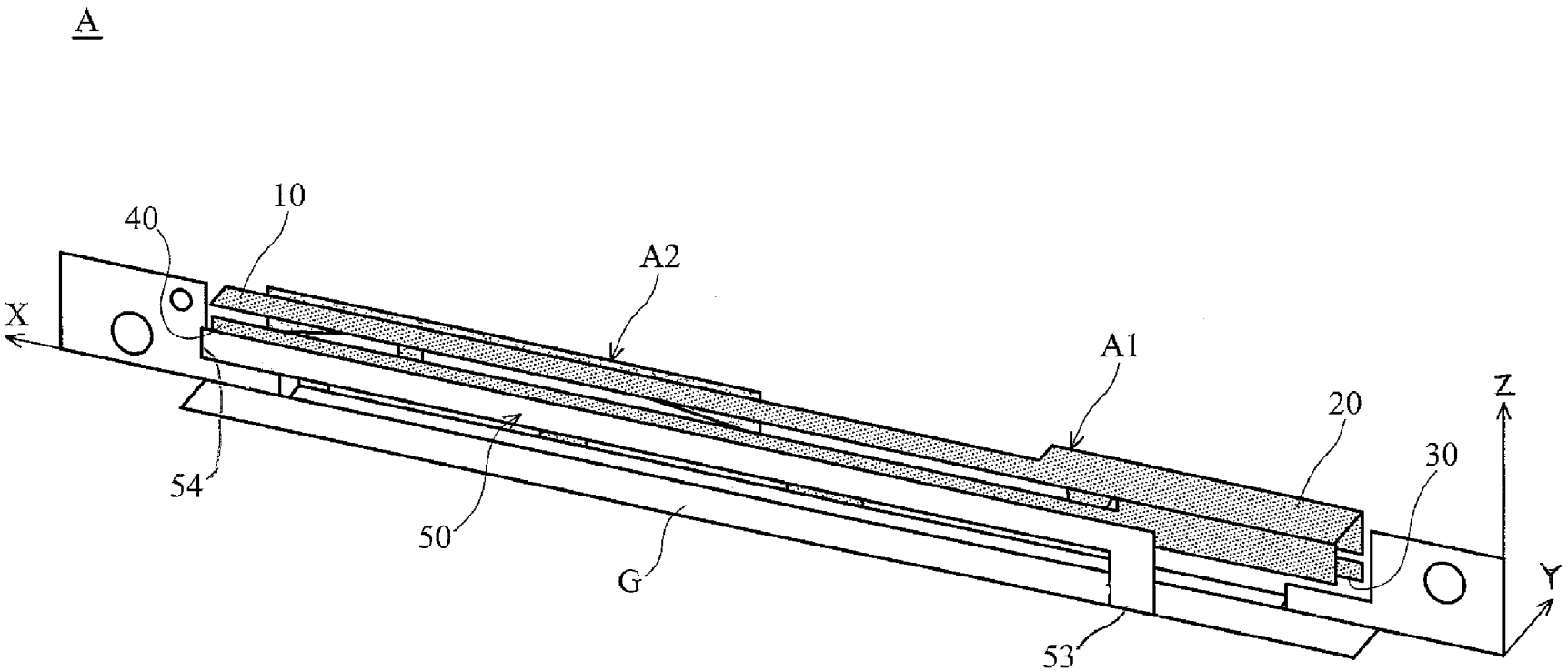

FIGS. 2, 3*a* and 3*b* show an antenna A of a first embodiment of the invention, comprising a ground element G, a first structure A1 and a second structure A2. The first structure A1 comprises a first transmission element 10, a second transmission element 20, a third transmission element 30, a fourth transmission element 40 and a first conductive element 100. The first conductive element 100 extends upward from the ground element G to connect the first, second and third transmission elements 10, 20 and 30. The fourth transmission element 40 is connected to the second transmission element 20. The first and fourth transmission elements 10 and 40 extend in a first direction X. The second and third transmission elements 20 and 30 extend in a second direction −X.

As shown in FIG. 3*a*, the first conductive element 100 comprises a first portion 110 and a second portion 120. The first portion 110 is L-shaped, an end of the first portion 110 is connected to the ground element C, and the other end thereof extends in the second direction −X. The second portion 120 comprises a first end 121, a second end 122, a first side 123 and a second side 124. The first portion 110 is connected to the first end 121. The first transmission element 10 is connected to the first side 123 nearing the second end 122. The second transmission element 20 is connected to the second side 124 nearing the second end 122. The third transmission element 30 is connected to the second side 124 nearing the first end 121.

With reference to FIGS. 3*a* and 3*b*, the ground element G is substantially located on a first plane (X-Y plane). The first conductive element 100 and the third transmission element 30 are substantially located on a second plane (X-Z plane) perpendicular to the first plane. The first transmission element 10 is substantially located on a third plane parallel to the first plane. The fourth transmission element 40 is substantially located on a fourth plane parallel to the second plane. The first and third planes are perpendicular to the second and fourth planes. The second transmission element 20 crosses the second, third, and fourth planes comprising a U-shaped structure. The second transmission element 20 nears the third transmission element 30, and maintains a first distance therefrom in a direction Z.

With reference to FIGS. 2, 3*a* and 3*b*, the antenna A further comprises a fifth transmission element 50, L-shaped and comprising a third end 53 and a fourth end 54. The third end 53 is connected to the ground element C. The fourth end 54 extends in direction X. The fifth transmission element 50 is located on a fifth plane parallel to the second plane as a parasitic element. The second portion 120 is located on a base line L. The base line L is located on the first plane, and perpendicular to the first direction X. The third end 53 maintains 0 to 10 mm with the base line. Additionally, the first conductive element 100 comprises a first coupling portion 10' parallel to the first transmission element 10.

With reference to FIGS. 2 and 3*a*, the second structure A2 comprises a second conductive element 200, a sixth transmission element 60 and a seventh transmission element 70. The second conductive element 200 is connected to the ground element G. The sixth and seventh transmission elements 60 and 70 are connected to the second conductive element 200, and extend separately in the first (X) and second (−X) directions. The second conductive element 200 comprises a second coupling portion 1" parallel and corresponding to the first transmission element 10.

Figure 4:
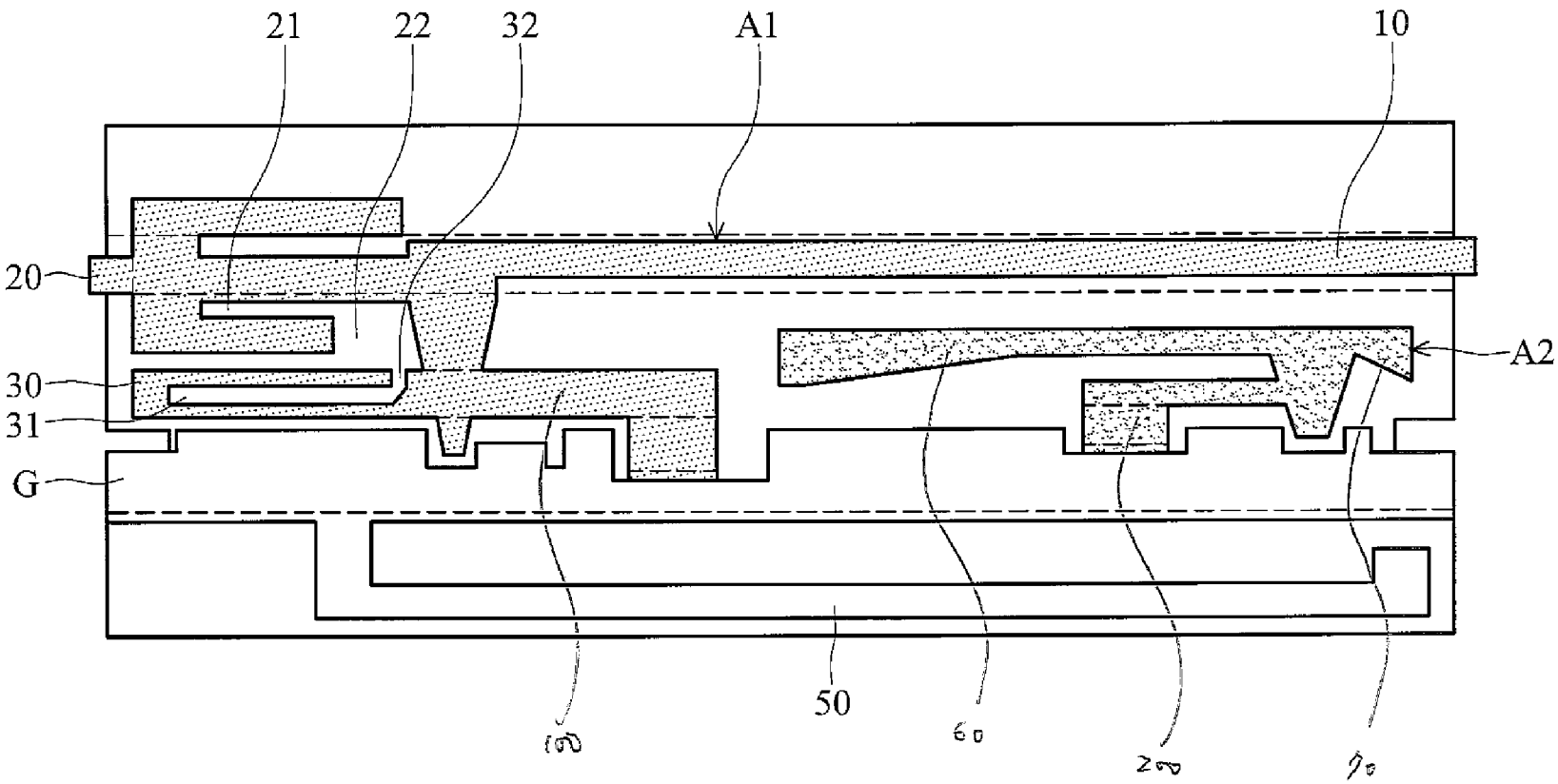
FIG. 4 is an extended view of a second embodiment of the invention.
Figure 5:
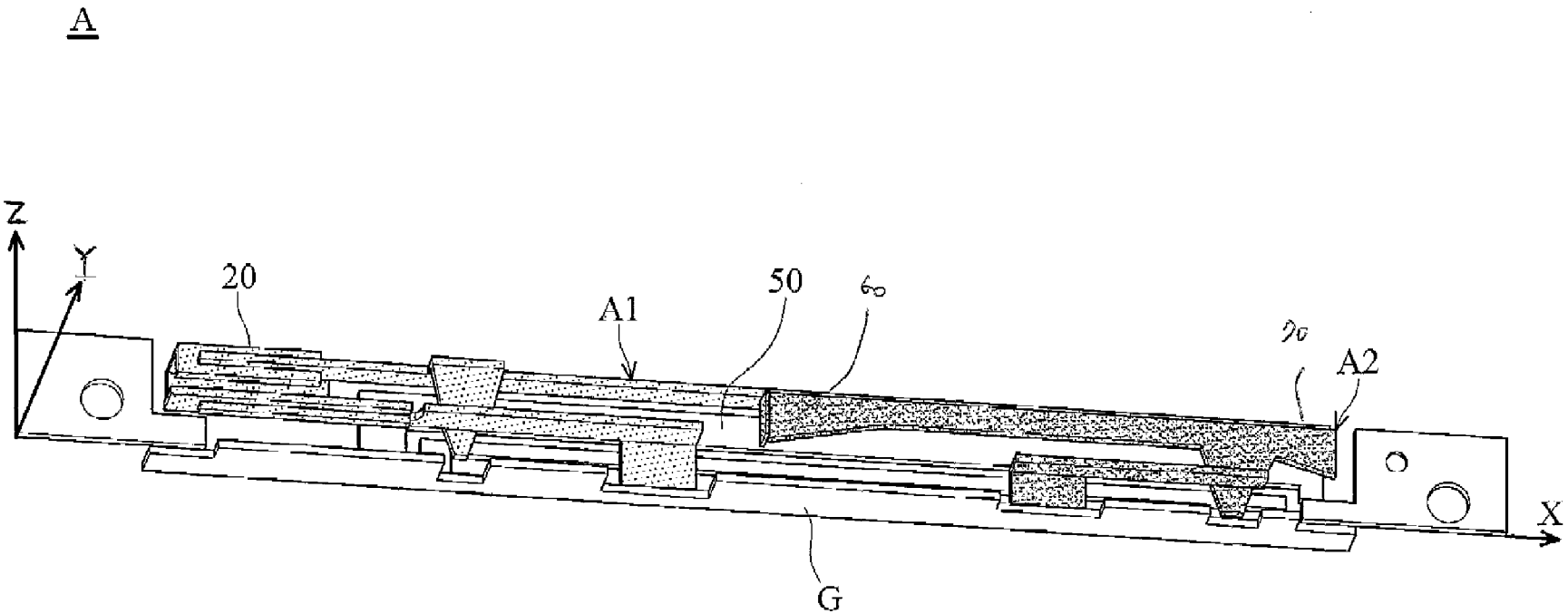
FIG. 5 is a perspective view of the second embodiment of the invention.

FIGS. 4 and 5 show an antenna A of a second embodiment of the invention, comprising a ground element G, a first structure A1 and a second structure A2. The first structure A1 comprises a first transmission element 10, a second transmission element 20, a third transmission element 30 and a first conductive element 100. The second structure A2 comprises a second conductive element 200, a sixth transmission element 60 and a seventh transmission element 70.

Here, the second transmission element 20 comprises a groove 21 formed on a center portion of the second transmission element 20 and a notch 22 formed on a side of the second transmission element 20. The notch 22 is connected to the groove 21. The third transmission element 30 comprises a groove 31 and a notch 32. The groove 31 is formed on a center portion of the third transmission element 30. The notch 32 is formed on a side of the third transmission element 30. The notch 32 is connected to the groove 31.

Figure 6:
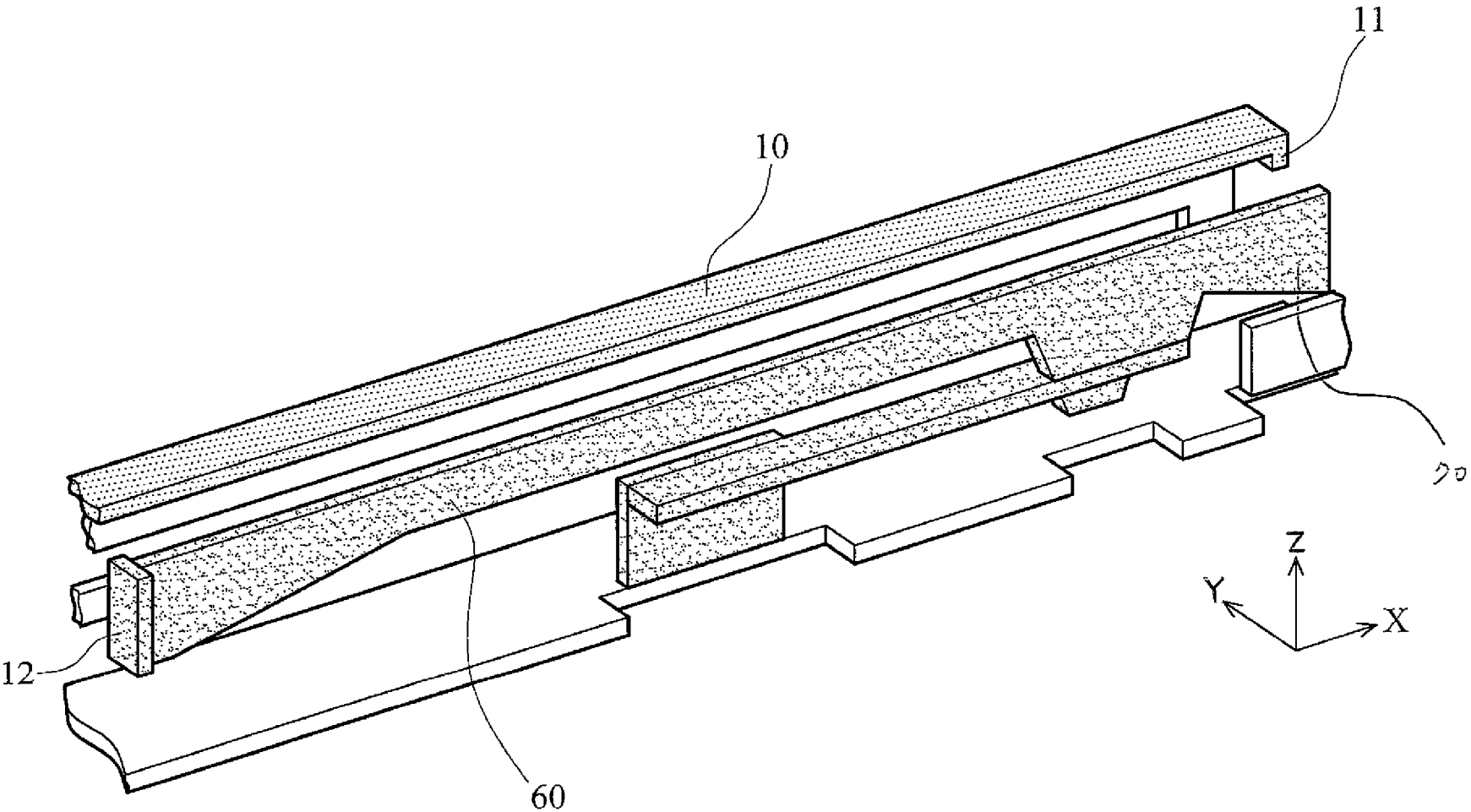
FIG. 6 shows a bent structure formed on a free end of the first transmission element.
Figure 7:
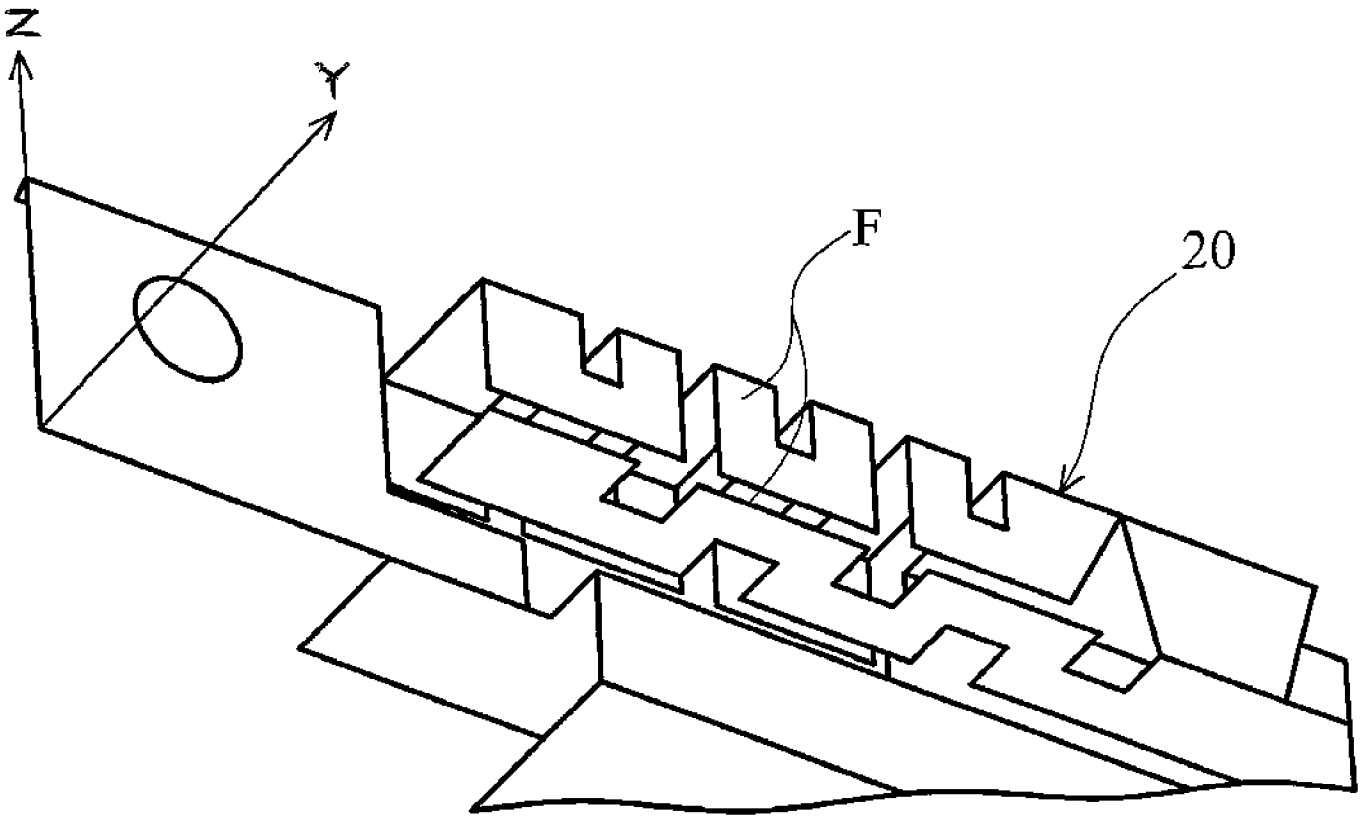
FIG. 7 shows a second transmission element comprising a tortuous structure.

As shown in FIG. 6, a free end of the first transmission element 10 comprises a bent structure 11 and a free end of the sixth transmission element 60 comprises a bent structure 12 to reduce the length of the antenna A. The bent structure can be formed on the free ends of other transmission elements to reduce the length of the antenna. As shown in FIG. 7, in a modified embodiment, the second transmission element 20 comprises a tortuous structure F to improve the transmission of the antenna.

Figure 8A:
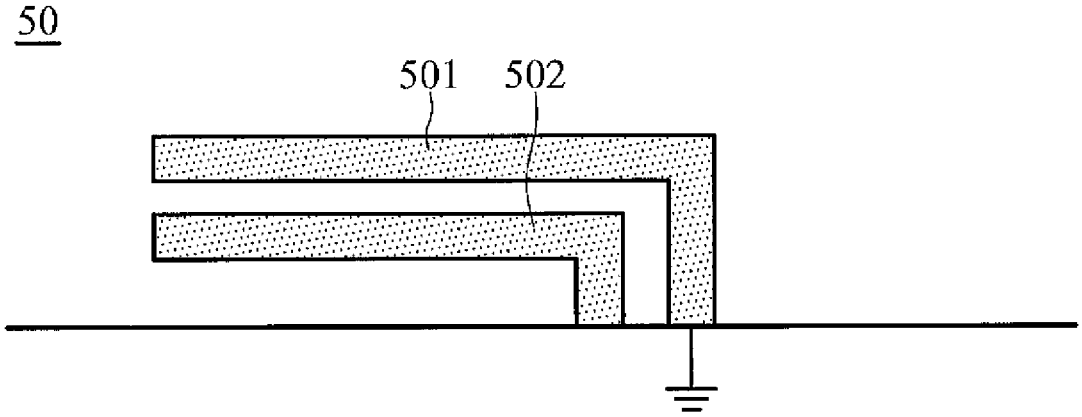
FIGS. 8*a*-8*g* show modified examples of a fifth transmission element.
Figure 8B:
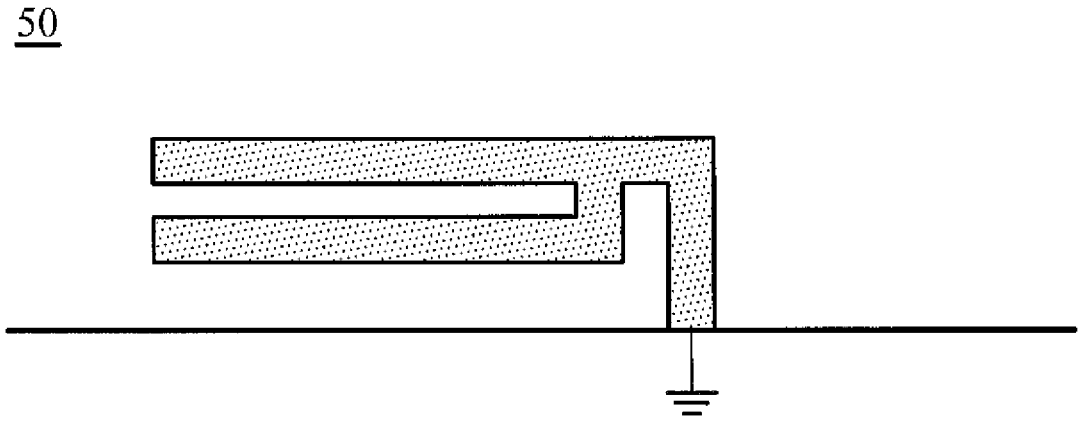
Figure 8C:
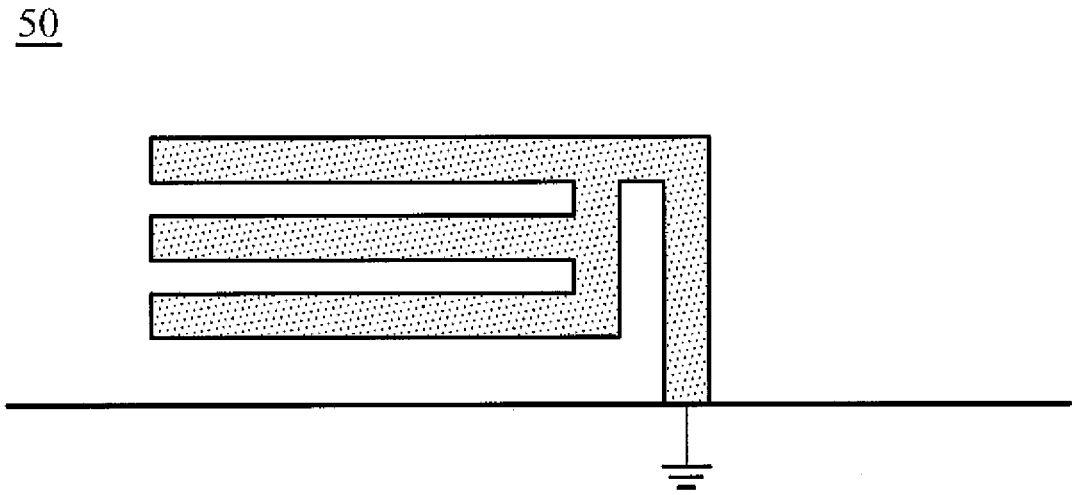
Figure 8D:
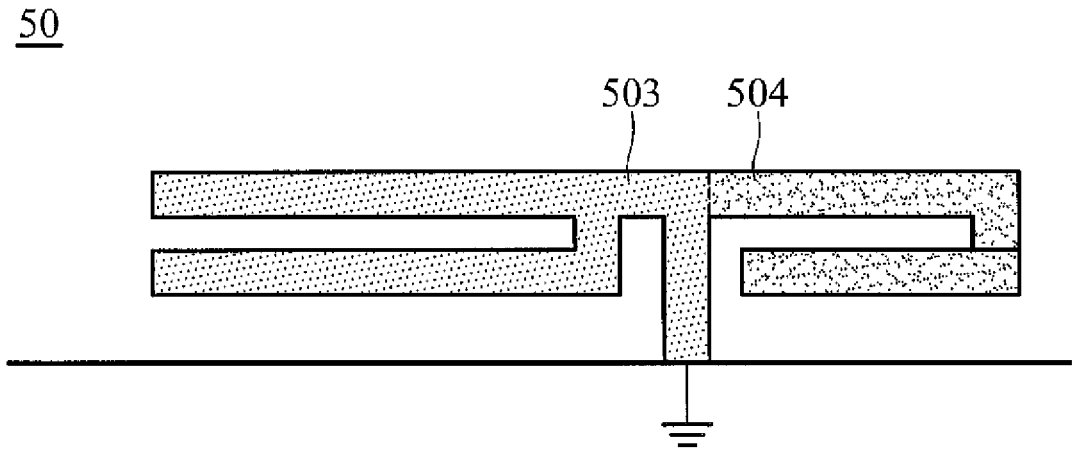
Figure 8E:
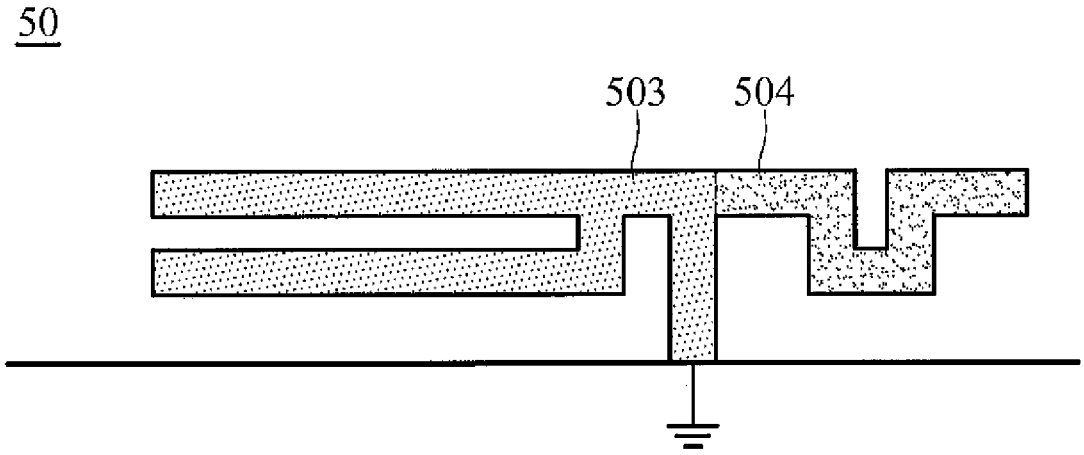
Figure 8F:
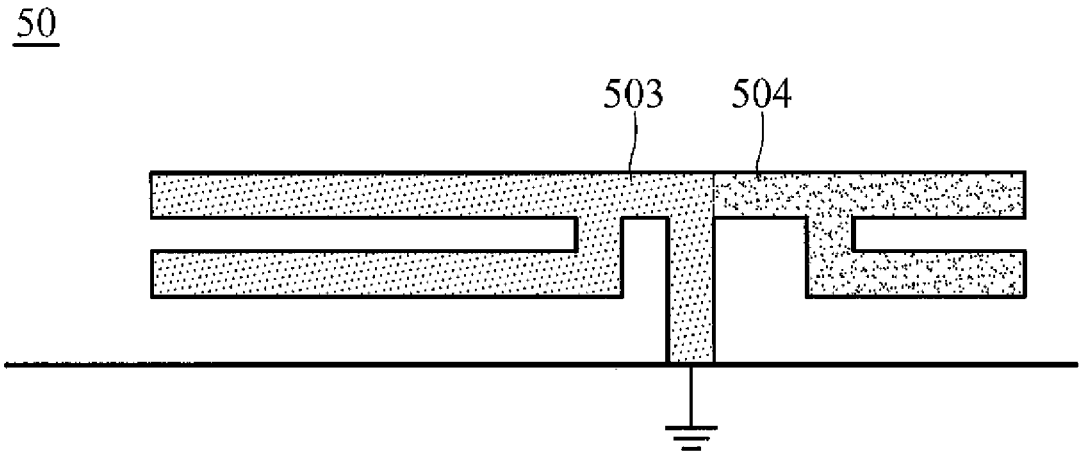
Figure 8G:
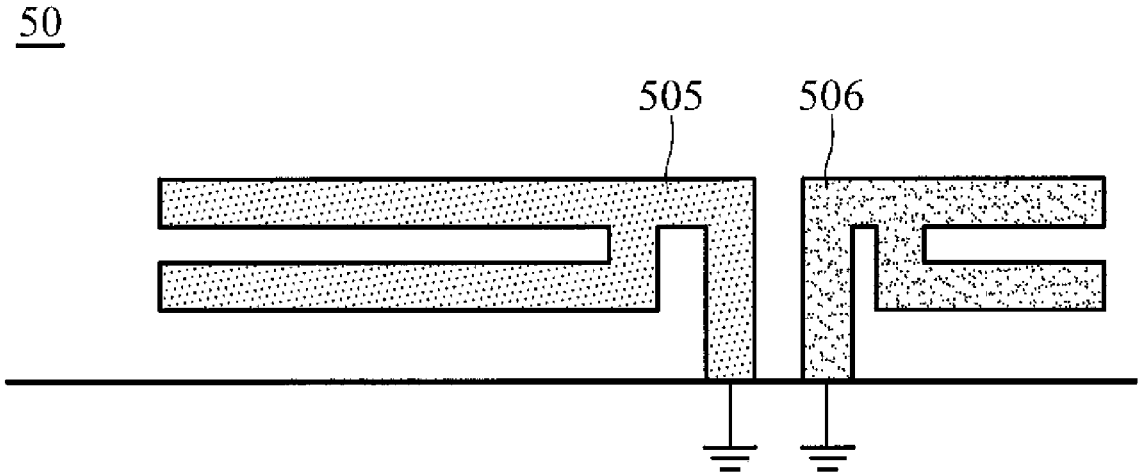

The fifth transmission element 50 may comprise any one of the structures shown in FIGS. 8*a* to 8*g*, such as two parallel L-shaped conductors 501 and 502 (as shown in FIG. 8*a*), a comb-shaped structure (as shown in FIGS. 8*b* and 8*c*), or two branch structures 503 and 504 extending in opposite directions (as shown in FIG. 8*d* to 8*f*). The branch structures 503 and 504 can be comb-shaped, tortuous, or symmetrical. Additionally, the fifth transmission element 50 also can comprise two separated comb-shaped structures 505 and 506 extending in opposite directions (as shown in FIG. 8*g*).

Figure 9A:
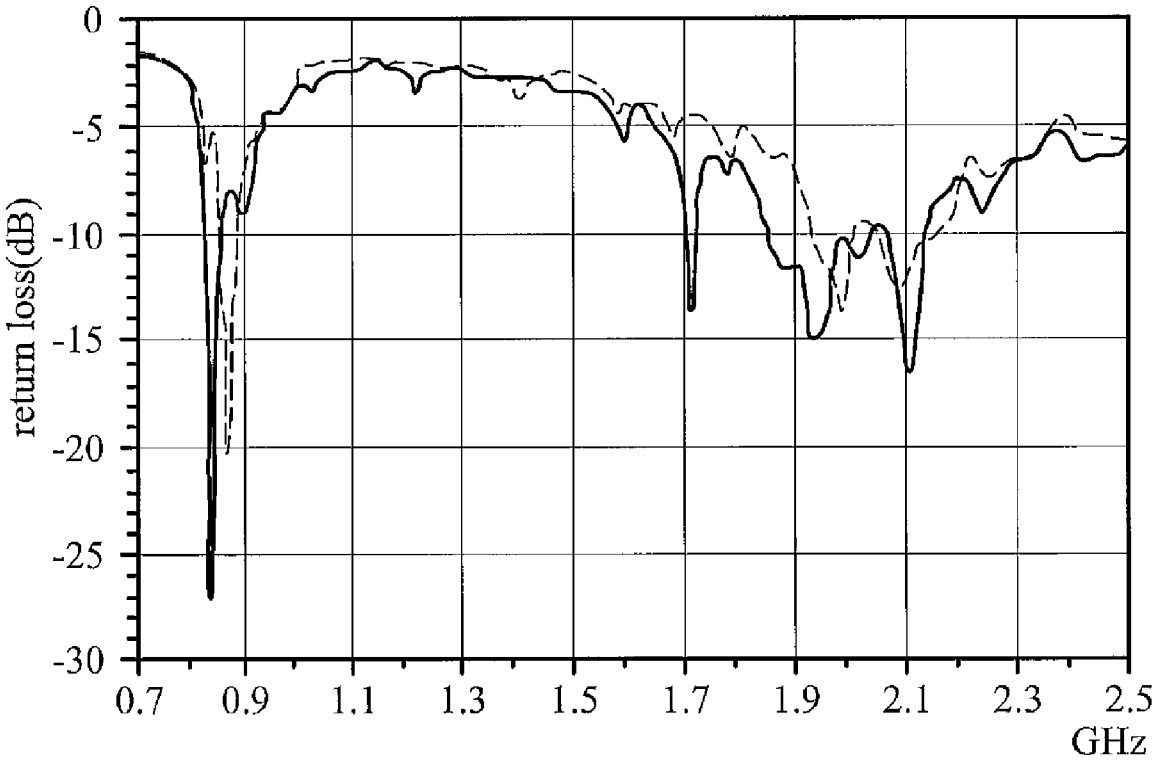
FIGS. 9*a* and 9*b* show transmission of the invention.
Figure 9B:
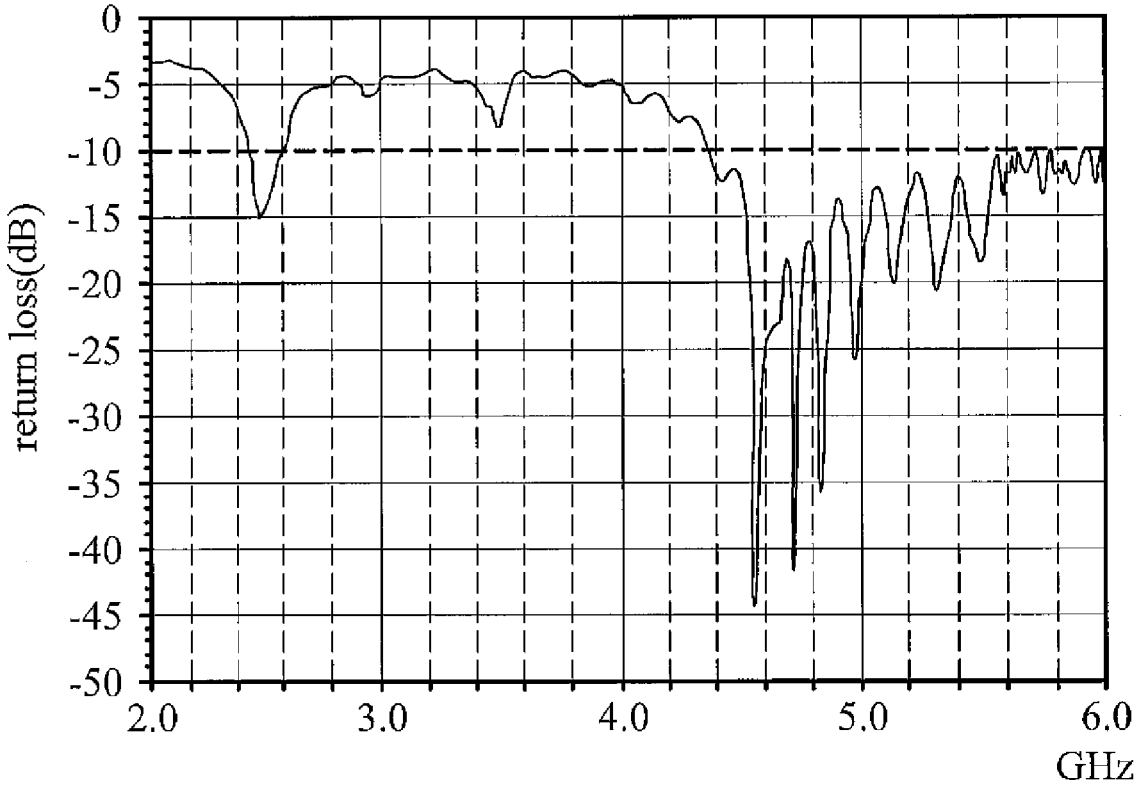

FIGS. 9*a* and 9*b* show the transmission of the antenna in FIG. 2 of the invention, wherein the antenna of the invention provides an improved transmission and a wider bandwidth between 0.8-0.95 GHz, 1.7-2.2 GHz, 2.4-2.6 GHz and 4.4-6.0 GHz.

Figure 10:
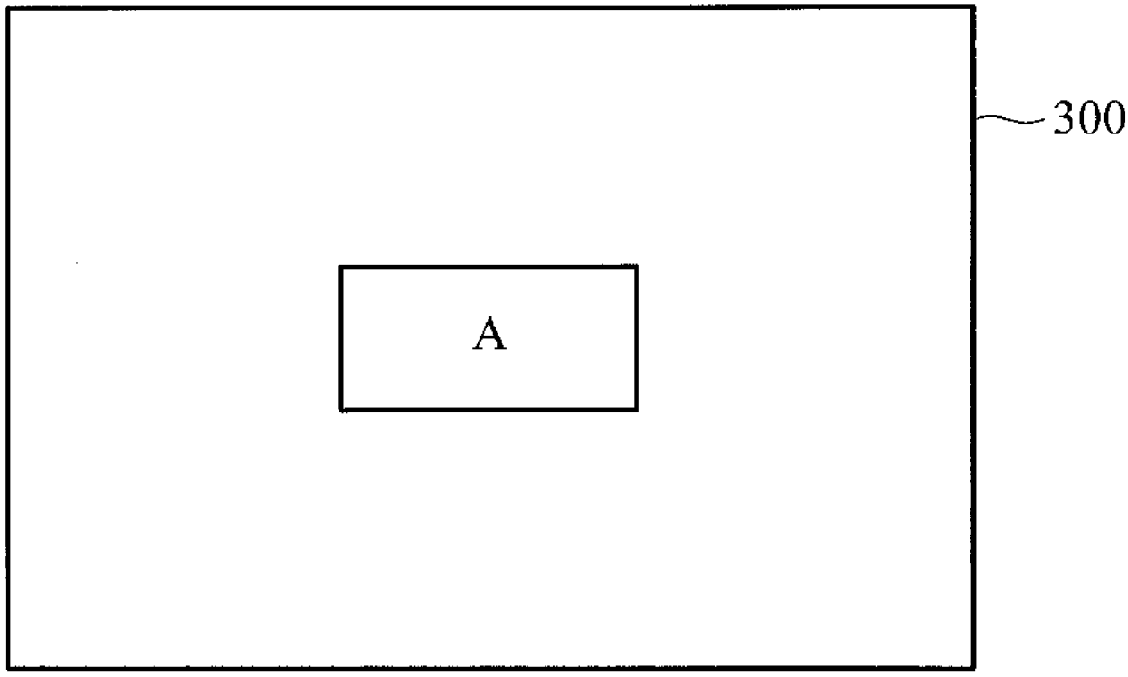
FIG. 10 shows an electronic device of the invention.

With reference to FIG. 10, the invention provides an electronic device 300 comprising the antenna A of the first and second embodiments. The electronic device 300 utilizing the antenna A of the invention provides wider bandwidth with improved transmission.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna, comprising:

a ground element;

a first conductive element, connected to the ground element;

a first transmission element, connected to the first conductive element extending in a first direction;

a second transmission element, connected to the first conductive element; and a third transmission element, connected to the first conductive element extending in a second direction opposite to the first direction, wherein the third transmission element nears the second transmission element, and maintains a first distance from the second transmission element.

2. The antenna as claimed in claim 1, wherein the first conductive element comprises a first portion and a second portion, the first portion is connected to the ground element, the second portion is connected to the first portion, and the first transmission element, the second transmission element, and the third transmission element are connected to the second portion.

3. The antenna as claimed in claim 2, wherein the second portion comprises a first end, a second end, a first side, and a second side, the first end is connected to the first portion, the first transmission element is connected to the first side near the second end, the second transmission element is connected to the second side near the second end, and the third transmission element is connected to the second side near the first end.

4. The antenna as claimed in claim 2, wherein the first portion is L-shaped, an end of the first portion is connected to the ground element, and another end of the first portion extends in the second direction connected to the second portion.

5. The antenna as claimed in claim 1, wherein the ground element is located on a first plane, and the first conductive element is substantially located on a second plane perpendicular to the first plane.

6. The antenna as claimed in claim 5, wherein the first transmission element is located on a third plane parallel to the first plane.

7. The antenna as claimed in claim 5, wherein the second transmission element crosses the second plane, the third plane and a fourth plane, and the fourth plane is parallel to the second plane.

8. The antenna as claimed in claim 5, further comprising a fourth transmission element connected to the second transmission element extending in the first direction, wherein the fourth transmission element is located on the fourth plane.

9. The antenna as claimed in claim 5, wherein the third transmission element is located on the second plane.

10. The antenna as claimed in claim 5, further comprising a fifth transmission element connected to the ground element located on a fifth plane parallel to the second plane, wherein the fifth transmission element is L-shaped, and comprises a third end connected to the ground element and a fourth end extending in the first direction.

11. The antenna as claimed in claim 5, further comprising a fifth transmission element connected to the ground element, wherein the fifth transmission element comprises a comb structure, a tortuous structure or a branch structure.

12. The antenna as claimed in claim 1, wherein the first conductive element further comprises a first coupling portion parallel to the first transmission element.

13. The antenna as claimed in claim 1, wherein the second transmission element comprises a groove and a notch, the groove formed on a center portion of the second transmission element, the notch formed on a side of the second transmission element, and the notch connected to the groove.

14. The antenna as claimed in claim 1, wherein the third transmission element comprises a groove and a notch, the groove is formed on a center portion of the third transmission element, the notch is formed on a side of the third transmission element, and the notch is connected to the groove.

15. The antenna as claimed in claim 1, wherein the second transmission element comprises a tortuous structure.

16. The antenna as claimed in claim 1, wherein the first transmission element comprises a bent structure formed on a free end thereof.

17. The antenna as claimed in claim 1, further comprising:

a second conductive element, connected to the ground element; and a sixth transmission element, connected to the second conductive element extending in the second direction.

18. The antenna as claimed in claim 17, wherein the second conductive element comprises a second coupling portion parallel to the first transmission element.

19. The antenna as claimed in claim 17, wherein the sixth transmission element comprises a bent portion formed on a free end thereof.

20. The antenna as claimed in claim 17, further comprising a seventh transmission element connected to the second conductive element extending in the first direction.

21. An antenna, comprising:

a ground element, located on a first plane;

a first conductive element, connected to the ground element and located on a second plane perpendicular to the first plane, wherein the first conductive element comprises a first portion and a second portion, the first portion is connected to the ground element, and the second portion is connected to the first portion;

a first transmission element, connected to the second portion extending in a first direction; and a fifth transmission element, connected to the ground element and located on a fifth plane parallel to the second plane.

22. The antenna as claimed in claim 21, wherein the fifth transmission element comprises an L-shaped structure, a comb structure, a tortuous structure or a branch structure.

23. The antenna as claimed in claim 21, wherein the second portion is located on a base line, the base line is on the first plane perpendicular to the first direction, and a third end of the fifth transmission element maintains a distance between 0 to 10 mm from the base line.

24. An electronic device, comprising:

an antenna comprising a ground element, a first conductive element, a first transmission element, a second transmission element and a third transmission element, the first conductive element connected to the ground element, the first transmission element connected to the first conductive element extending in a first direction, the second transmission element connected to the first conductive element, the third transmission element connected to the first conductive element extending in a second direction opposite to the first direction, wherein the third transmission element nears the second transmission element, and maintains a first distance from the second transmission element.

25. An electronic device, comprising:

an antenna comprising a ground element, a first conductive element, a first transmission element and a fifth transmission element, the ground element located on a first plane, the first conductive element connected to the ground element and substantially located on a second plane, the second plane perpendicular to the first plane, the first transmission element connected to the first conductive element extending in a first direction, the fifth transmission element connected to the ground element located on a fifth plane parallel to the second plane, wherein the fifth transmission element is L-shaped, an end of the fifth transmission element is connected to the ground element, and another end thereof extends in the first direction.

* * * * *